United States Patent [19]

Harsch et al.

[11] Patent Number: 4,648,736

[45] Date of Patent: Mar. 10, 1987

[54] RELEASABLE COUPLER, PARTICULARLY FOR GRIPPER RAILS IN A TRANSFER PRESS

[75] Inventors: Erich Harsch, Weingarten; Reiner Reichenbach, Unterankenreute, both of Fed. Rep. of Germany

[73] Assignee: Maschinenfabrik Müller-Weingarten AG, Weingarten, Fed. Rep. of Germany

[21] Appl. No.: 782,608

[22] Filed: Oct. 1, 1985

[30] Foreign Application Priority Data

Oct. 2, 1984 [DE] Fed. Rep. of Germany ..... 3436075

[51] Int. Cl.[4] ..... F16B 7/00; B21J 13/08

[52] U.S. Cl. ..... 403/297; 403/292; 403/290; 403/31; 269/43; 269/48.1; 279/2 R

[58] Field of Search ..... 403/297, 292, 369, 248, 403/290, 31; 279/2 R, 7; 269/43, 48.1; 100/207

[56] References Cited

U.S. PATENT DOCUMENTS

| | | | |
|---|---|---|---|
| 151,482 | 6/1874 | Ferren | 269/43 |
| 2,739,559 | 3/1956 | Mitchell | 269/48.1 |
| 2,977,916 | 4/1961 | Hawkins | 269/48.1 |
| 3,742,186 | 6/1973 | Finkel et al. | 269/48.1 X |
| 4,382,711 | 5/1983 | Lafosse et al. | 403/290 |

FOREIGN PATENT DOCUMENTS

| | | | |
|---|---|---|---|
| 3300227 | 7/1984 | Fed. Rep. of Germany . | |
| 420815 | 8/1974 | U.S.S.R. | 403/292 |

*Primary Examiner*—Cornelius J. Husar
*Assistant Examiner*—Todd G. Williams
*Attorney, Agent, or Firm*—Spencer & Frank

[57] ABSTRACT

A releasable coupling for connecting a first and a second component to one another, includes a first sleeve-like hollow member affixed to an end of the first component and a second sleeve-like hollow member affixed to an end of the second component, an expander mandrel supported in the first hollow member and arranged for an axial motion with respect to the first hollow member to assume an advanced position in which it projects into the second hollow member to be surrounded simultaneously by the first and second hollow members. The expander mandrel includes an expander element and pressing elements operatively connected to the expander element for displacement generally radially outwardly by the expander element into an expanded position for a simultaneous engagement with the first and second hollow elements thereby clamping the first and second components to one another. There is further provided a power device for axially displacing the expander mandrel as a whole and for displacing the expander element relative to the pressing elements. Each pressing element has a toothed outer face and each hollow member has a toothed inner face. In the advanced position of the expander mandrel and in the expanded position of the pressing elements each toothed outer face is in a meshing engagement with both toothed inner faces.

6 Claims, 10 Drawing Figures

RELEASABLE COUPLER, PARTICULARLY FOR GRIPPER RAILS IN A TRANSFER PRESS

BACKGROUND OF THE INVENTION

This invention relates to a releasable coupling device particularly for releasably connecting gripper rail parts of gripper rails in a transfer press. For performing a tool replacement, the tools, together with the associated gripper rail parts, are moved out of the press transversely to its length, while the unaffected gripper rail components remain in place.

In transfer presses, for advancing the workpieces from one stage to a successive stage, gripper rail transport systems are provided whose gripper rails extend along the entire length of the press. In performing tool replacement it has been inconvenient that, while the tool units could readily be moved out of the press, the gripper rails first had to be released from their drives and then had to be pulled out of the press in a direction parallel to their length (that is, parallel to the press length).

To overcome the above-outlined drawback, the gripper rails are conventionally subdivided and interconnected in such a manner that, upon release, the gripper rail component associated with the tool to be replaced, could be moved out of the work tool chamber together with the tool as a unit. For this purpose, for example, the abutting ends of the gripper rail parts are screwed to one another with the aid of splicer plates. The disadvantage of this arrangement resides in the fact that the connections are very unstable, they are not capable of carrying substantial transverse loads and further, the construction includes "loose components" during tool replacement which have to be set aside, thus risking damage or loss of such components.

According to another solution, eccentric tightening devices are used in which the ends of the individual gripper rail components are tightened face-to-face to one another. For this purpose, however, a precise fit was required and further, this construction is exposed to significant wear. Also, with this type of coupling, it is not feasible to obtain a sufficiently large separating clearance for moving out the rail portions on the supporting carriage. The result has been a complex disassembling operation requiring a significant amount of time for the tool replacement.

According to a significantly improved device, disclosed in German Pat. No. 3,300,227, on the end faces of gripper rail parts sleeve members are secured. In one sleeve member an expander mandrel is slidably arranged which extends, in the operative state, into the adjoining sleeve member. The expander mandrel provides, by means of pressing members, a form-fitting connection with grooves provided in the inner faces of the sleeve members. The manufacture of this construction, however, has been found to be extremely time-consuming and the device has a great number of components which, in order to permit a positive force transmission, have to be accurately machined.

SUMMARY OF THE INVENTION

It is an object of the invention to provide an improved, simplified coupling device of the type disclosed in German Pat. No. 3,300,227.

This object and others to become apparent as the specification progresses, are accomplished by the invention, according to which, briefly stated, the releasable coupling for connecting a first and a second component to one another, includes a first sleeve-like hollow member affixed to an end of the first component and a second sleeve-like hollow member affixed to an end of the second component, an expander mandrel supported in the first hollow member and arranged for an axial motion with respect to the first hollow member to assume an advanced position in which it projects into the second hollow member to be surrounded simultaneously by the first and second hollow members. The expander mandrel includes an expander element and pressing elements operatively connected to the expander element for displacement generally radially outwardly by the expander element into an expanded position for a simultaneous engagement with the first and second hollow elements thereby clamping the first and second components to one another. There is further provided a power device for axially displacing the expander mandrel as a whole and for displacing the expander element relative to the pressing elements. Each pressing element has a toothed outer face and each hollow member has a toothed inner face. In the advanced position of the expander mandrel and in the expanded position of the pressing elements each toothed outer face is in a meshing engagement with both toothed inner faces.

The invention thus provides a simpler gripper rail connection by means of teeth forming, for example, a toothed rack and wherein in the closed state of the connection the force path directly extends from the toothed configuration of one sleeve member to that of the other sleeve member, with the intermediary of the teeth of the pressing members. The teeth of the toothed racks are of chevron configuration whereby a form-fitting connection in all planes is ensured. The drive of the expander mandrel may be effected by a spindle element operated by electric means or by a piston rod operated by a hydraulic or pneumatic power cylinder.

According to another feature of the invention, in the operative position of the expander member a spring arrangement becomes effective which is adapted to exert a continuous force on the expander member towards its locking position. This feature permits a de-energization of the drive at the end of the closing motion.

DESCRIPTION OF THE PREFERRED EMBODIMENTS

Figure 1:
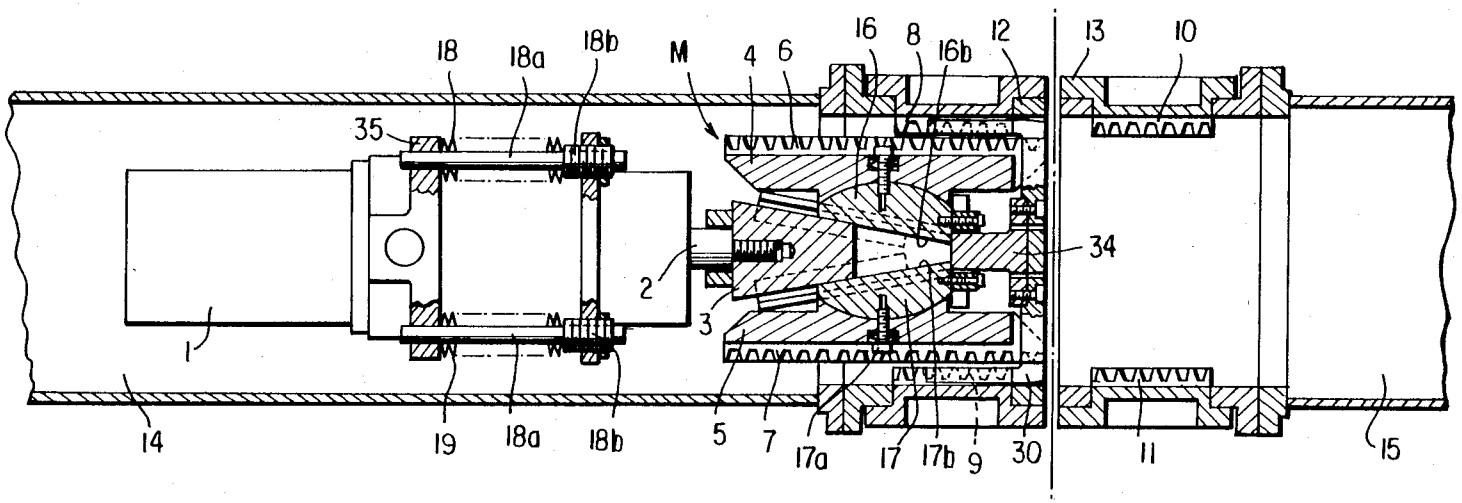
FIG. 1 is an axial sectional view of a preferred embodiment of the invention in an open state.
Figure 2:
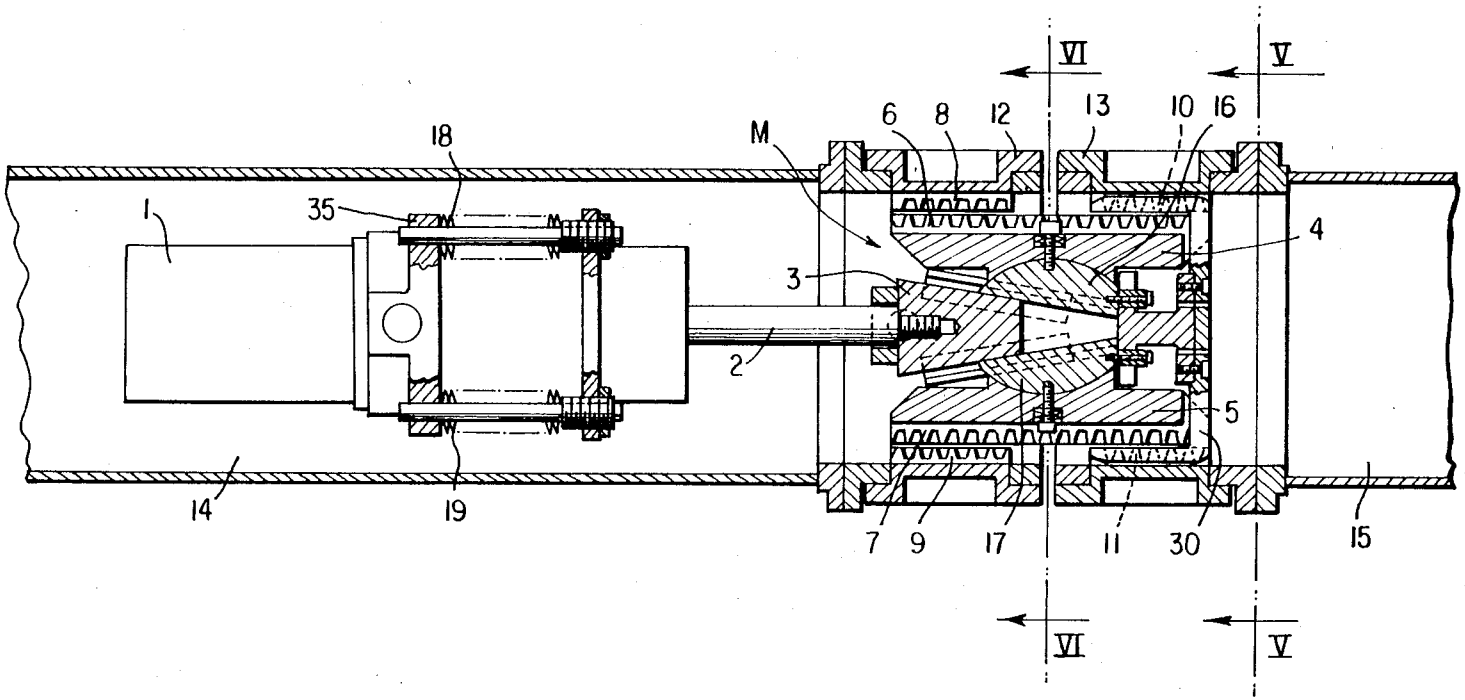
FIG. 2 is an axial sectional view of the same embodiment in a closed but unlocked state.
Figure 4:
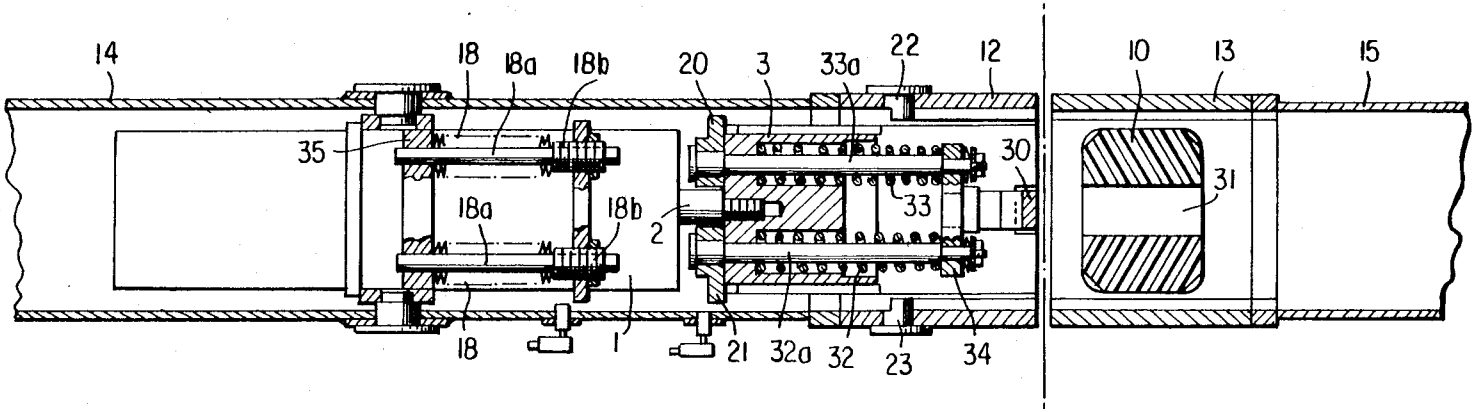
FIG. 4 is an axial sectional view of the same embodiment in its state shown in FIG. 1, viewed in a plane oriented perpendicularly to the sectional plane of FIG. 1.
Figure 6:
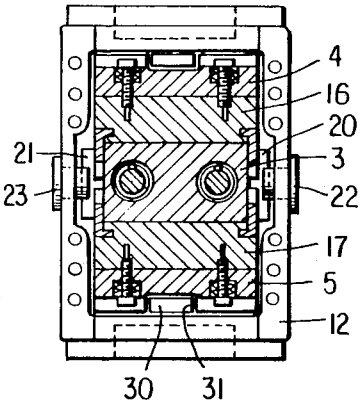
FIG. 6 is a sectional view taken along line VI—VI of FIG. 2.
Figure 5:
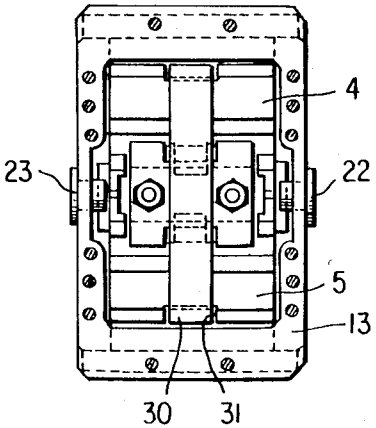
FIG. 5 is a sectional view taken along line V—V of FIG. 2.
Figure 7:
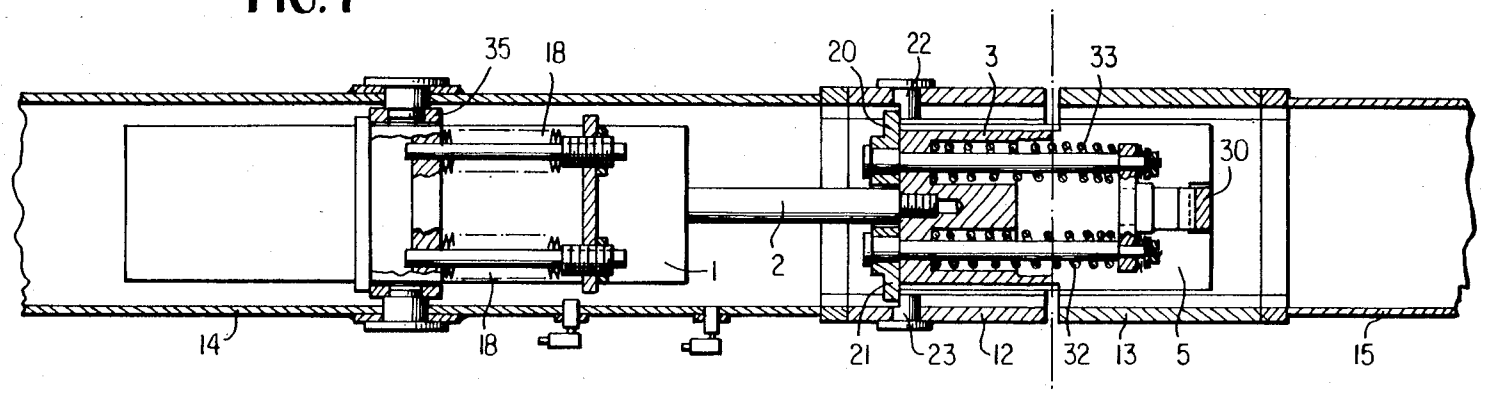
FIG. 7 is an axial sectional view of the preferred embodiment in its state shown in FIG. 2, viewed in a plane oriented perpendicularly to the sectional plane of FIG. 2.

Turning now to FIGS. 1 and 4, there is illustrated therein a preferred embodiment of the releasable coupling according to the invention. The purpose of the coupling which is shown in a separated state in FIGS. 1 and 4, is to firmly join together, end-to-end, two elongated machine components, such as two gripper rail parts 14 and 15 forming part of a gripper rail assembly in a multi-stage transfer press.

The releasable coupling comprises a power mechanism, such as a driving cylinder 1 which is situated in the gripper rail part 14 and from which extends, in axial alignment with the end-to-end positioned gripper rail parts 14 and 15, an actuating bar 2, such as a piston rod or spindle, arranged for axial movement as driven by the power device 1. A frame 35 is stationarily secured to the gripper rail part 14 and has guide rails 18*a*, 19*a* on which the power device 1 is axially slidably mounted by guide sleeves 18*b*, 19*b*. Thus, as will be described later, if the power device 1 seeks to advance the bar 2 towards the right, but the latter is prevented from executing such a motion, reaction forces will cause the power device 1 to slide leftward, compressing springs 18, 19 mounted on the guide rails 18*a*, 19*a*.

At the end of the bar 2 there is carried an expander mandrel generally designated at M. The expander mandrel M has a wedge 3 mounted directly on the end of the bar 2 as well as diametrically oppositely located pressing members 4 and 5. Each pressing member has a cradle-like curved surface into which complementally fits a support member 16 and 17, respectively, secured to the pressing members 4 and 5 by screws 16*a* and 17*a*. Each support member 16 and 17 has a slanted face 16*b* and 17*b* cooperating with respective wedge faces of the wedge member 3.

The wedge 3 is axially displaceable with respect to the pressing members 4 and 5 by virtue of mounting bars 32*a* and 33*a* as well as respective coil springs 32 and 33 which urge the wedge 3 axially away from the pressing members 4 and 5. The pressing members 4 and 5 are secured to a bridge member 34 connecting the mounting bars 32*a* and 33*a* with one another.

The pressing members 4 and 5 have outer faces which have chevron-shaped toothed portions 6 and 7, respectively.

In the open state of the releasable coupling, as depicted in FIG. 1, the expander mandrel M is situated essentially in its entirety in a sleeve 12 flanged to the right-hand end of the gripper rail part 14. To the left-hand end of another gripper rail part 15 there is flanged another sleeve 13. Both sleeves 12 and 13 which, for performing a coupling operation, are brought into axial alignment with one another, have, at their inner faces, toothed portions 8–11 of chevron-like configuration, as shown in FIG. 4.

In the description which follows, the operation of the described coupler will be set forth.

Figure 3:
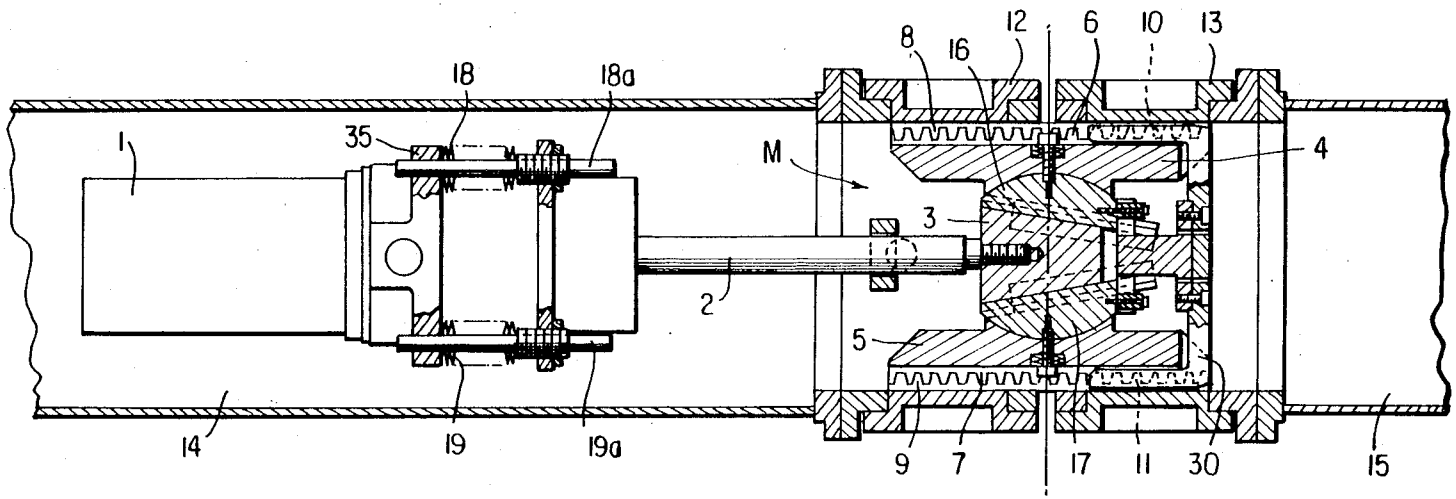
FIG. 3 is an axial sectional view of the same embodiment illustrated in a closed and locked state.
Figure 8:
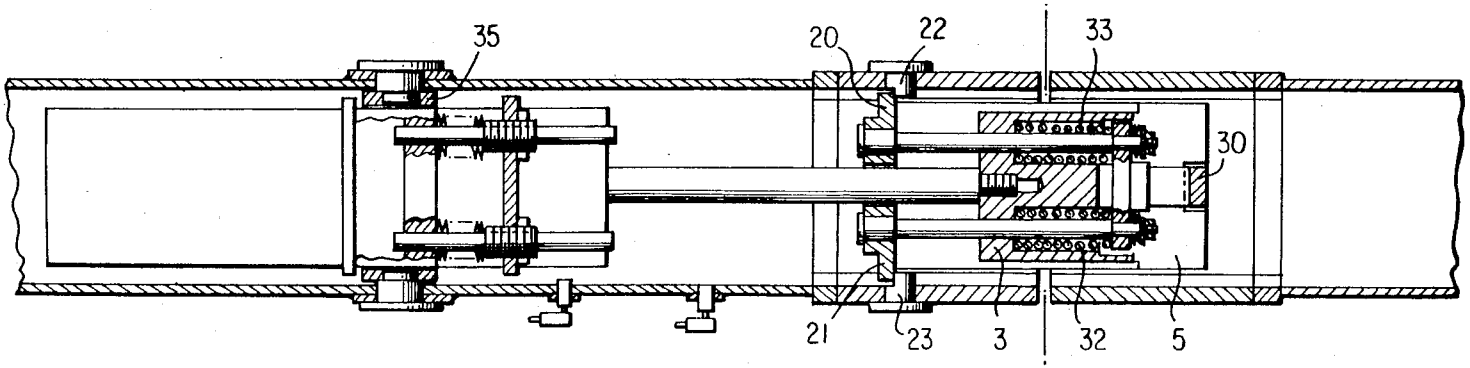
FIG. 8 is an axial sectional view of the preferred embodiment in its state shown in FIG. 3, viewed in a plane oriented perpendicularly to the sectional plane of FIG. 3.

By energizing the power cylinder 1, such as a spindle drive, the expander mandrel M is shifted by the spindle 2 into the sleeve 13 until the expander mandrel M assumes the position illustrated in FIGS. 2, 5, 6 and 7. The expander mandrel M, upon its introduction into the sleeve 13, is guided by the guide portion 30 in a guide groove 31 of the sleeve 13. In the position of the mandrel M shown in FIG. 2, the outer teeth 6 and 7 of the pressing members 4 and 5 are situated in operative alignment with the teeth 8–11 of the sleeves 12 and 13. In this position, the pressing members 4 and 5, with their respective lugs 20 and 21 (shown, for example, in FIG. 7) abut against stops 22 and 23 of the sleeve 12, while the wedge member 3 continues to move towards the right as viewed in FIG. 2. By means of the wedge faces of the wedge 3 the two pressing members 4 and 5 are displaced radially outwardly whereby the outer teeth 6 and 7 arrive in a meshing relationship with the teeth 8–11 of the sleeves 12 and 13 as shown in FIGS. 3 and 8. An undesired relative motion of the wedge 3 with respect to the pressing members 4 and 5 is prevented by the springs 32 and 33 during the axial travel of the expander mandrel M as a unit into the sleeve 13, until the above-noted abutting relationship between lugs 20, 21 and stops 22, 23 occurs.

As the meshing relationship between the pressing members 4 and 5 on the one hand and the inner faces 8–11 of the sleeves 12 and 13 on the other hand occurs, the pressing members 4 and 5 are prevented from further outer radial movement, thus preventing the wedge 3 from performing any forward axial motion. As the rod 2 of the drive 1 continues its forward motion, by virtue of the blocked wedge member 3 reaction forces are generated which cause the power device 1 to slide towards the left on guide rails 18*a*, 19*a*, compressing the springs 18 and 19 to assume a position as illustrated in FIG. 3. Thus, a tensioning of the bar 2 towards the right is effected which is maintained by a braking device (not shown). Consequently, a continuous spring force is axially exerted on the wedge member 3, ensuring a locked condition of the pressing members 4 and 5 with the respective inner faces of the sleeves 12 and 13 even in a de-energized state of the power mechanism 1.

By virtue of the cradle-like arrangement of the pressing members 4, 5 by the supporting members 16, 17, on each side of the coupling identical clamping forces are obtained.

Figure 9:
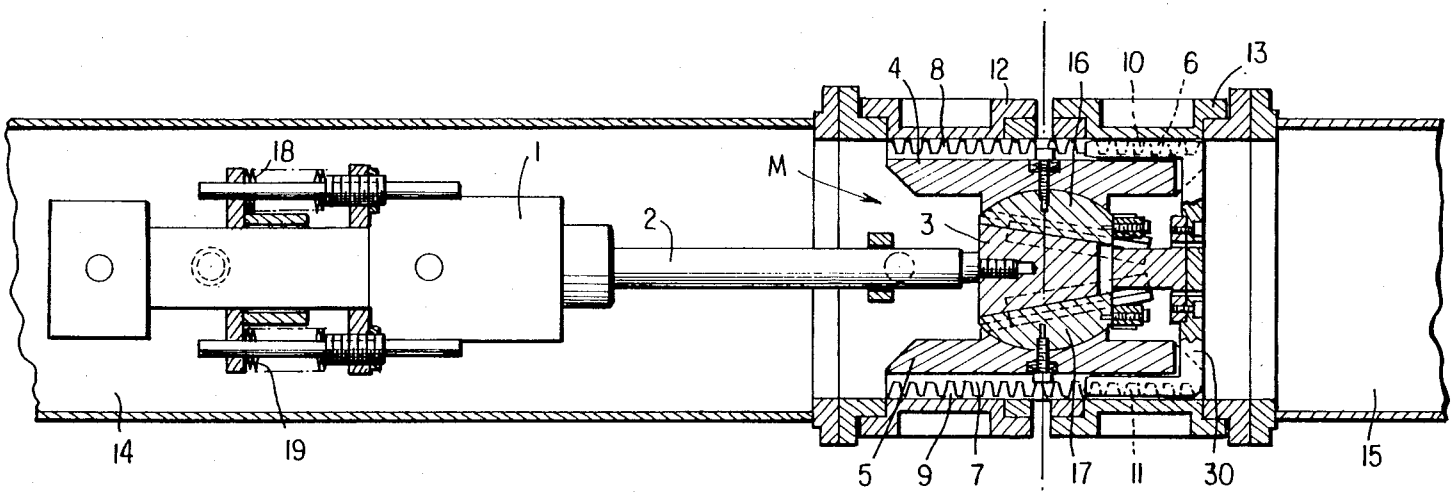
FIG. 9 is an axial sectional view similar to FIG. 3, illustrating another preferred embodiment.
Figure 10:
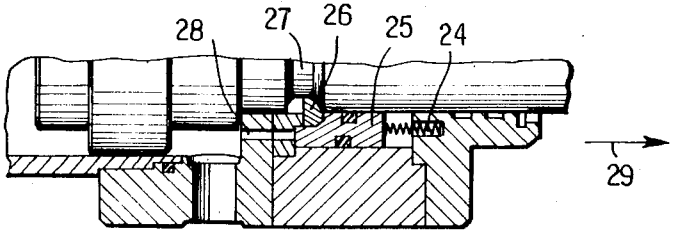
FIG. 10 is an axial sectional view of a component illustrated in FIG. 9.

Turning to FIGS. 9 and 10, there is shown a power cylinder 1*a* which is a hydraulic cylinder in which the above-described locked tensioning by the compressed springs 18 and 19 after meshing engagement is effected by a spring 24 which exerts a force on a pressing member 25 which, in turn, causes a detent member 26 to project into a cooperating groove 27 formed in the bar 2. For releasing the locked clamping force of the compressed springs 18 and 19, hydraulic pressure is exerted on the pressing member 25 through a port 28, whereupon the pressing member 25 is shifted in the direction of the arrow 29 against the force of the spring 24 and, at the same time, the detent 26 is pushed out of the groove 27. Upon this occurrence the compressed springs 18 and 19 may expand, while shifting the power cylinder 1*a* towards the right relative to the bar 2 until the springs 18, 19 assume their relaxed state.

It will be understood that the above description of the present invention is susceptible to various modifications, changes and adaptations, and the same are intended to be comprehended within the meaning and range of equivalents of the appended claims.

What is claimed is:

1. In a releasable coupling for connecting a first and a second component to one another, including a first sleeve-like hollow member affixed to an end of the first component and a second sleeve-like hollow member affixed to an end of the second component, an expander mandrel supported in said first hollow member and arranged for an axial motion with respect to said first hollow member to assume an advanced position in which it projects partially into said second hollow member to be surrounded simultaneously by said first and second hollow members; said expander mandrel including an expander element and pressing elements operatively connected to said expander element for displacement generally radially outwardly by said expander element into an expanded position for a simultaneous engagement with said first and second hollow elements thereby securing said first and second components to one another; and power means for axially displacing said expander mandrel and for displacing said expander element relative to said pressing elements; the improvement wherein each pressing element has a toothed outer face and each hollow member has a toothed inner face; in said advanced position of said expander mandrel and in said expanded position of said pressing elements each toothed outer face being in a meshing engagement with both toothed inner faces.

2. A releasable coupling as defined in claim 1, wherein said power means includes an axially displaceable bar carrying said expander mandrel; said expander element having wedging faces; said pressing elements carrying slanted faces cooperating with said wedging faces for moving said pressing elements into said expanded position upon an axial displacement of said expander element by said power means.

3. A releasable coupling as defined in claim 2, further comprising support members each having a curved outer face being in a conforming engagement with a curved surface portion of a respective said pressing element; securing means attaching the support members to respective said pressing elements; said slanted faces being provided on said support members.

4. A releasable coupling as defined in claim 1, wherein said power means comprises a power cylinder supported by said first component and being axially displaceable relative to said first component; further comprising spring means in engagement with said power cylinder for being compressed by reaction forces axially displacing said power cylinder and derived from said power means after said pressing elements have reached said expanded position, whereby said expander member is spring-biased in said expanded position of said pressing elements.

5. A releasable coupling as defined in claim 4, further comprising locking means for immobilizing said power cylinder in a position in which said spring means is compressed.

6. A releasable coupling as defined in claim 1, wherein said toothed inner and outer faces comprise teeth of chevron-like configuration.

* * * * *